US010220485B2

(12) United States Patent
Xue et al.

(10) Patent No.: US 10,220,485 B2
(45) Date of Patent: Mar. 5, 2019

(54) ONLINE BURR REMOVING DEVICE FOR WHEEL

(71) Applicant: CITIC Dicastal CO., LTD, Qinhuangdao (CN)

(72) Inventors: Bowen Xue, Qinhuangdao (CN); Haiping Chang, Qinhuangdao (CN); Jiandong Guo, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 62 days.

(21) Appl. No.: 15/423,683

(22) Filed: Feb. 3, 2017

(65) Prior Publication Data

US 2018/0085887 A1 Mar. 29, 2018

(30) Foreign Application Priority Data

Sep. 24, 2016 (CN) ..... 2016 1 0845442

(51) Int. Cl.
*B24B 29/04* (2006.01)
*B24B 29/00* (2006.01)

(52) U.S. Cl.
CPC ..... *B24B 29/04* (2013.01); *B24B 29/005* (2013.01)

(58) Field of Classification Search
CPC .. B24B 5/44; B24B 9/00; B24B 29/04; B24B 29/005
USPC ..... 451/194
See application file for complete search history.

(56) References Cited

U.S. PATENT DOCUMENTS

| | | | | |
|---|---|---|---|---|
| 3,258,804 | A * | 7/1966 | Fowle | B24B 5/225 15/104.011 |
| 5,890,952 | A * | 4/1999 | Beaupre | B23Q 3/18 451/168 |
| 5,906,537 | A * | 5/1999 | Elcock | B23C 3/30 451/194 |
| 6,217,424 | B1 * | 4/2001 | Stephens | B24B 5/44 451/254 |
| 6,722,961 | B2 * | 4/2004 | Solanellas | B23Q 1/54 451/140 |
| 9,724,796 | B2 * | 8/2017 | Xue | B24B 9/04 |
| 9,782,866 | B1 * | 10/2017 | Xue | B24B 9/04 |
| 2013/0102233 | A1 * | 4/2013 | Cheon | B24B 27/033 451/331 |
| 2016/0354891 | A1 * | 12/2016 | Xue | B24B 5/44 |

FOREIGN PATENT DOCUMENTS

| | | | |
|---|---|---|---|
| JP | H 03294136 | A * | 12/1991 |
| JP | 3044289 | B2 * | 5/2000 |

* cited by examiner

*Primary Examiner* — Marc Carlson
(74) *Attorney, Agent, or Firm* — Calfee, Halter & Griswold LLP

(57) ABSTRACT

The present invention discloses an online burr removing device for a wheel. The device comprises a brush moving system, online transfer parts, clamp units, a lifting plate rotating part. When the device is used, one motor can simultaneously drive an inner brush, an outer brush and a plurality of round brushes to rotate, and the rotating speeds of the three kinds of brushes can be appropriate by setting an appropriate drive ratio; the device can avoid the problem that the linear speed is low in the center but high at the outer edge when an integrated brush rotates at the same angular speed; meanwhile, the device has the characteristics of high automation degree, advanced process, simple structure and high safety and stability.

1 Claim, 2 Drawing Sheets

ONLINE BURR REMOVING DEVICE FOR WHEEL

CROSS-REFERENCE TO RELATED APPLICATIONS

This application claims priority to Chinese Patent Application No. 201610845442.5, filed on Sep. 24, 2016, which is hereby incorporated by reference in its entirety.

TECHNICAL FIELD

The present invention relates to a burr removing device, specifically to an online burr removing device for a wheel.

BACKGROUND ART

In the production process of an aluminum alloy wheel, a large amount of burrs are produced on the cutter outlet side of a spoke due to the cutting action of a cutter during machining, and the burrs may severely influence the following coating effect if not removed timely. At present, burrs are removed on special equipment by using a large disc brush in the traditional burr removing mode, and in such a mode, when the brush rotates at certain angular speed, the linear speed of its inner bristles are much lower than the outer bristles, so that burrs are always brushed excessively or cannot be brushed. In order to solve the phenomenon, each part of the brush must move in different speed and mode, and thus the device emerges for solving the problem.

SUMMARY OF THE INVENTION

The objective of the present invention is to provide an online burr removing device for a wheel. One motor can simultaneously drive an inner brush, an outer brush and a plurality of round brushes to rotate, and the rotating speeds of the three kinds of brushes can be appropriate by setting an appropriate drive ratio.

In order to fulfill the above objective, the present invention adopts the technical solution: the device comprises a frame, a motor I, a fixed plate I, guide posts I, guide sleeves I, a large belt pulley, a synchronous belt, small belt pulleys, a lower lifting plate, shafts I, a shaft II, bearing seats I, a transition sleeve, a bearing seat H, a fixed plate II, turnover cylinders, swivels, shafts III, gears I, gear rings, gears H, an outer brush, round brushes, an inner brush, supports, roller beds, end face blocks, corner cylinders, slide plates, guide rails, a fixed plate HI, servo electric cylinders I, a shaft IV, a bearing seat III, an upper lifting plate, a motor II, guide posts II, guide sleeves II, servo electric cylinders II, platforms and cylinders II, wherein a brush moving system includes: the four guide sleeves I and the two cylinders II are fixed on the fixed plate I, and the four guide posts I matched with the guide sleeves I are fixed below the lower lifting plate; the output ends of the cylinders II are articulated with the lower part of the lower lifting plate; the motor I is fixed below the lower lifting plate via a flange; the transition sleeve and the bearing seat II are fixed on the lower lifting plate, and the bearing seat II is arranged inside the transition sleeve; a plurality of bearing seats I are also fixed on the lower lifting plate and uniformly distributed outside the transition sleeve; the shaft II is installed inside the bearing seat II via a bearing; the large belt pulley is fixed below the shaft II; the shafts I are installed inside the bearing seats I via bearings; the gears I are installed above the shafts I, and the small belt pulleys are installed below the shafts I; the large belt pulley is connected with the small belt pulleys by the synchronous belt; the fixed plate II is fixed above the transition sleeve; an inner ring of each swivel is fixed above the fixed plate II, and an outer ring is fixed below a gear ring; the outer brush is installed above the gear rings; the gears I are engaged with the outer sides of the gear rings; a plurality of shafts III are uniformly fixed above the fixed plate II; the gears II are installed on the shafts III via bearings; a plurality of round brushes are uniformly fixed above the gears II; the gears II are engaged with the inner sides of the gear rings; and the inner brush is fixed above the shaft II.

Each online transfer unit includes: a cylinder body of a turnover cylinder is articulated to the side of the frame, and an output rod of the turnover cylinder is articulated with the lower part of a support; a plurality of roller beds are installed above the support; and the left side of the support is articulated with the upper part of a platform. The device includes a left online transfer unit and a right online transfer unit.

Each clamp unit includes: an end face block and a corner cylinder are fixed below a slide plate; the slide plate is installed below the fixed plate III via a guide rail; a servo electric cylinder I is fixed on the fixed plate III, and the output end of the servo electric cylinder I is connected with the slide plate. The device includes three clamp units.

A lifting plate rotating part includes: the four guide posts II are fixed on the upper lifting plate; the motor II is fixed in the middle of the upper lifting plate via a flange; the bearing seat 111 is fixed below the upper lifting plate; the shaft IV is installed inside the bearing seat III via a bearing; the lower part of the bearing seat III is connected with the fixed plate III, and the upper part of the bearing seat III is connected with the output end of the motor II; the four guide sleeves II matched with the guide posts II are fixed at the top of the frame; the two servo electric cylinders II are also fixed at the top of the frame, and the output ends of the servo electric cylinders II are articulated with the upper part of the upper lifting plate.

In actual use, the servo electric cylinders II adjust the heights of the clamp units via the guide posts II according to the height of the wheel; the servo electric cylinders I adjust the positions of the clamp units via the guide rails according to the diameter of the wheel, the corner cylinders clamp the wheel, and the motor II drives the wheel to rotate via the shaft IV; the turnover cylinders pull the supports, and the roller beds on the left and right sides turn down; the motor I drives the inner brush and the large belt pulley to rotate via the shaft II; meanwhile, the synchronous belt, the small belt pulleys and the shafts I drive the gears I to rotate; the gear rings and the swivels drive the outer brush to rotate; the gear rings are engaged with the gears II, so that the plurality of round brushes also rotate; the cylinders II drive the rotating inner brush, outer brush and the plurality of round brushes to rise via the guide posts I, and burrs on the back cavity can be removed when the brushes contact the back cavity of the wheel.

When the device in the present invention is used, one motor can simultaneously drive the inner brush, the outer brush and the plurality of round brushes to rotate, and the rotating speeds of the three kinds of brushes can be appropriate by setting an appropriate drive ratio; the device can avoid the problem that the linear speed is low in the center but high at the outer edge when an integrated brush rotates at the same angular speed; meanwhile, the device has the characteristics of high automation degree, advanced process, simple structure and high safety and stability.

Figure 1:
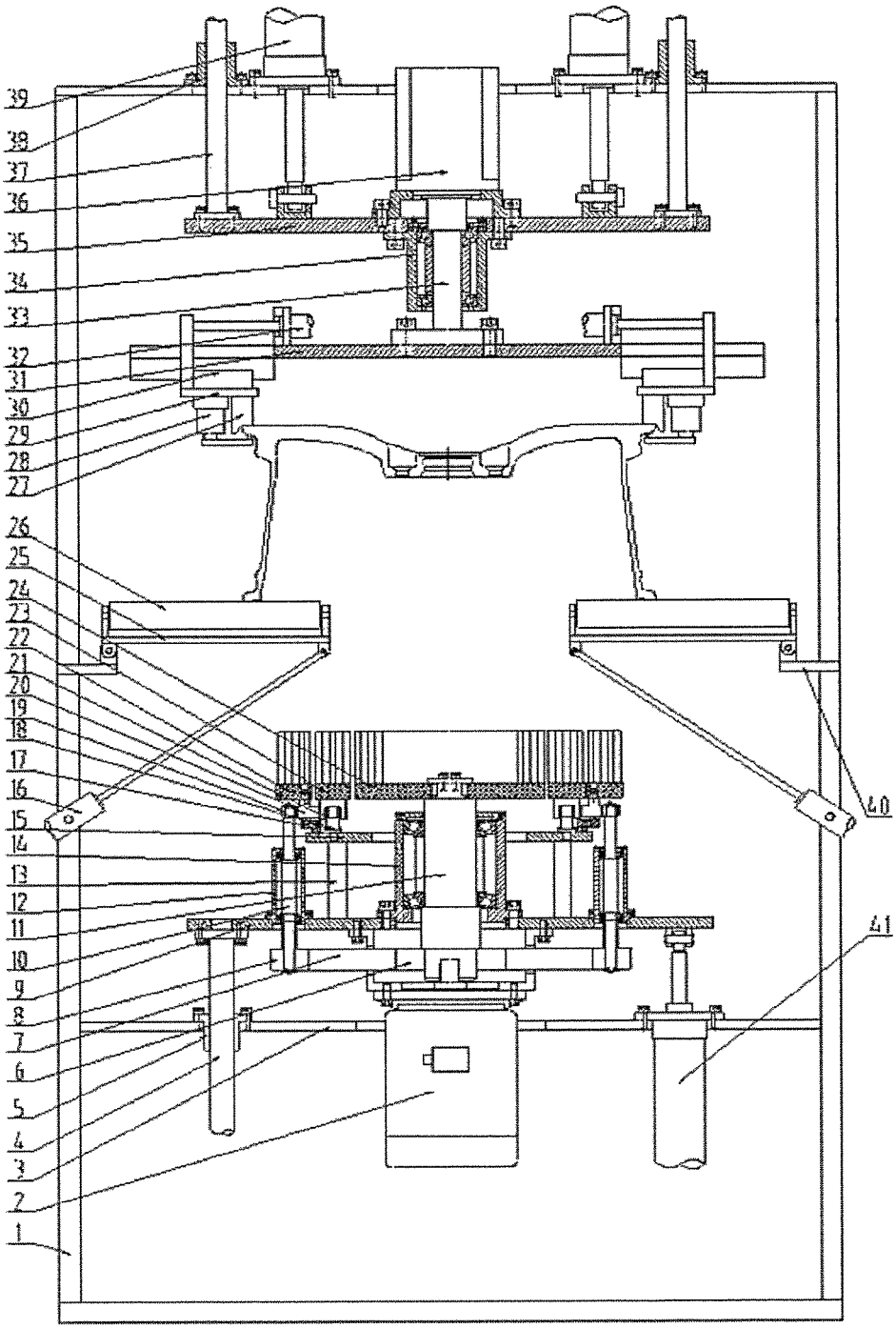
FIG. 1 is a front view of an online burr removing device for a wheel in the present invention.
Figure 2:
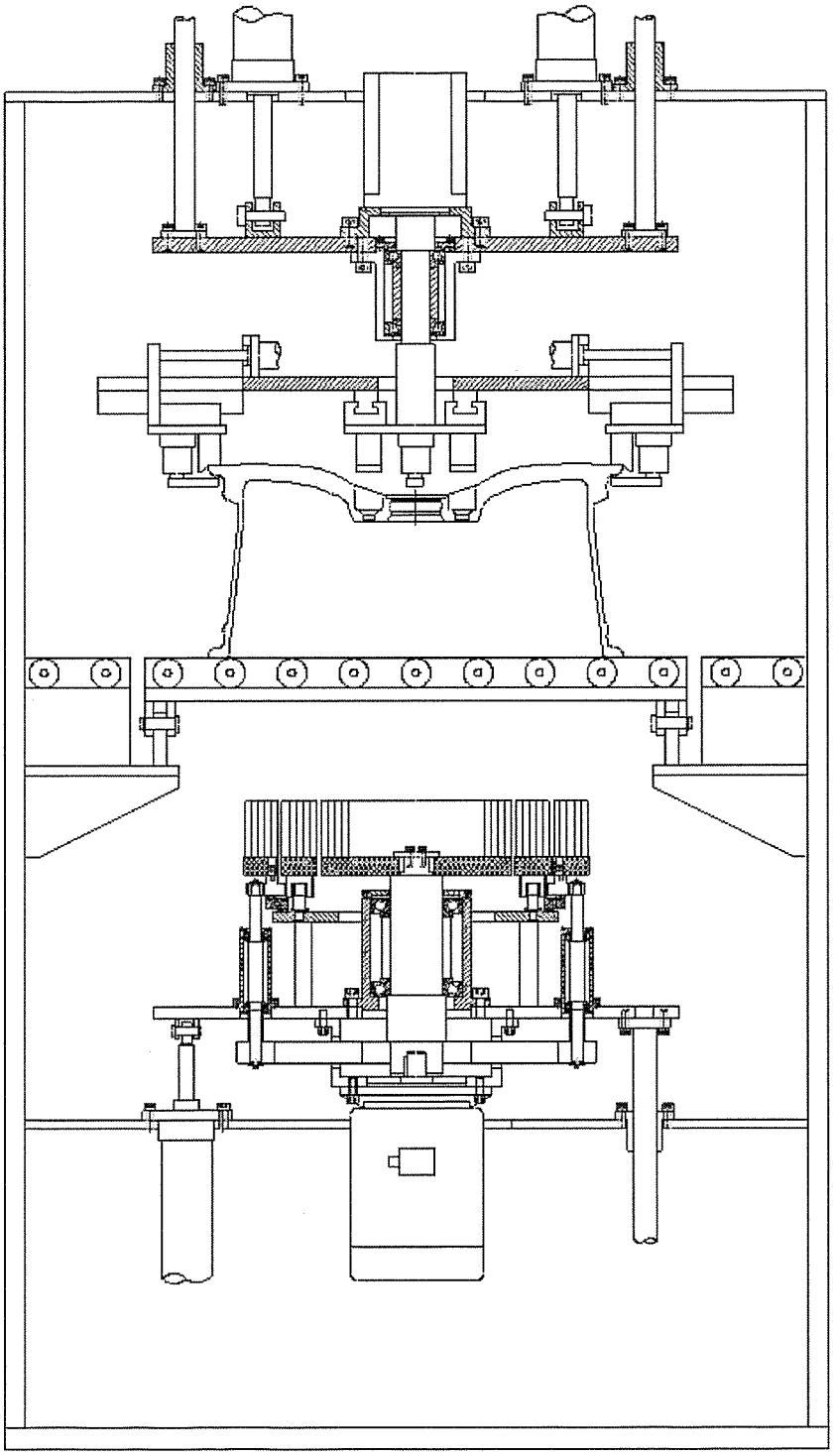
FIG. 2 is a left view of the online burr removing device for a wheel in the present invention.

In figures, 1—frame, 2—motor I, 3—fixed plate I, 4—guide post I, 5—guide sleeve I, 6—large belt pulley, 7—synchronous belt, 8—small belt pulley, 9—lower lifting plate, 10—shaft I, 11—shaft II, 12—bearing seat I, 13—transition sleeve, 14—bearing seat II, 15—fixed plate II, 16—turnover cylinder, 17—swivel, 18—shaft III, 19—gear I, 20—gear ring, 21—gear II, 22—outer brush, 23—round brush, 24—inner brush, 25—support, 26—roller bed, 27—end face block, 28—corner cylinder, 29—slide plate, 30—guide rail, 31—fixed plate HI, 32—servo electric cylinder I, 33—shaft IV, 34—bearing seat III, 35—upper lifting plate, 36—motor II, 37—guide post II, 38—guide sleeve II, 39—servo electric cylinder II, 40—platform, 41—cylinder II.

DETAILED DESCRIPTION OF THE INVENTION

Details and working conditions of a specific device provided by the present invention will be described below in combination with the accompanying drawings.

The device is composed of a frame 1, a motor I 2, a fixed plate I 3, guide posts I 4, guide sleeves I 5, a large belt pulley 6, a synchronous belt 7, small belt pulleys 8, a lower lifting plate 9, shafts I 10, a shaft II 11, bearing seats I 12, a transition sleeve 13, a bearing seat II 14, a fixed plate II 15, turnover cylinders 16, swivels 17, shafts HI 18, gears 119, gear rings 20, gears II 21, an outer brush 22, round brushes 23, an inner brush 24, supports 25, roller beds 26, end face blocks 27, corner cylinders 28, slide plates 29, guide rails 30, a fixed plate III 31, servo electric cylinders I 32, a shaft IV 33, a bearing seat III 34, an upper lifting plate 35, a motor II 36, guide posts II 37, guide sleeves II 38, servo electric cylinders II 39, platforms 40 and cylinders H 41, wherein a brush moving system includes: the four guide sleeves I 5 and the two cylinders II 41 are fixed on the fixed plate I 3, and the four guide posts I 4 matched with the guide sleeves I 5 are fixed below the lower lifting plate 9; the output ends of the cylinders II 41 are articulated with the lower part of the lower lifting plate 9; the motor I 2 is fixed below the lower lifting plate 9 via a flange; the transition sleeve 13 and the bearing seat II 14 are fixed on the lower lifting plate 9, and the bearing seat II 14 is arranged inside the transition sleeve 13; a plurality of bearing seats I 12 are also fixed on the lower lifting plate 9 and uniformly distributed outside the transition sleeve 13; the shaft II 11 is installed inside the bearing seat II 14 via a bearing; the large belt pulley 6 is fixed below the shaft II 11; the shafts I 10 are installed inside the bearing seats I 12 via bearings; the gears I 19 are installed above the shafts I 10, and the small belt pulleys 8 are installed below the shafts I 10; the large belt pulley 6 is connected with the small belt pulleys 8 by the synchronous belt 7; the fixed plate II 15 is fixed above the transition sleeve 13; an inner ring of each swivel 17 is fixed above the fixed plate II 15, and an outer ring is fixed below a gear ring 20; the outer brush 22 is installed above the gear rings 20; the gears I 19 are engaged with the outer sides of the gear rings 20; a plurality of shafts III 18 are uniformly fixed above the fixed plate II 15; the gears II 21 are installed on the shafts III 18 via bearings; a plurality of round brushes 23 are uniformly fixed above the gears II 21; the gears II 21 are engaged with the inner sides of the gear rings 20; and the inner brush 24 is fixed above the shaft II 11.

Each online transfer unit includes: a cylinder body of a turnover cylinder 16 is articulated to the side of the frame 1, and an output rod of the turnover cylinder 16 is articulated with the lower part of a support 25; a plurality of roller beds 26 are installed above the support 25; and the left side of the support 25 is articulated with the upper part of a platform 40. The device includes a left online transfer unit and a right online transfer unit.

Each clamp unit includes: an end face block 27 and a corner cylinder 28 are fixed below a slide plate 29; the slide plate 29 is installed below the fixed plate III 31 via a guide rail 30; a servo electric cylinder I 32 is fixed on the fixed plate III 31, and the output end of the servo electric cylinder I 32 is connected with the slide plate 29. The device includes three clamp units.

A lifting plate rotating part includes: the four guide posts II 37 are fixed on the upper lifting plate 35; the motor II 36 is fixed in the middle of the upper lifting plate 35 via a flange; the bearing seat III 34 is fixed below the upper lifting plate 35; the shaft IV 33 is installed inside the bearing seat III 34 via a bearing; the lower part of the bearing seat III 34 is connected with the fixed plate III 31, and the upper part of the bearing seat III 34 is connected with the output end of the motor II 36; the four guide sleeves II 38 matched with the guide posts II 37 are fixed at the top of the frame 1; the two servo electric cylinders II 39 are also fixed at the top of the frame 1, and the output ends of the servo electric cylinders II 39 are articulated with the upper part of the upper lifting plate 35.

In the working process, the servo electric cylinders II 39 adjust the heights of the clamp units via the guide posts II 37 according to the height of the wheel; the servo electric cylinders I 32 adjust the positions of the clamp units via the guide rails 30 according to the diameter of the wheel, the corner cylinders 28 clamp the wheel, and the motor II 36 drives the wheel to rotate via the shaft IV 33; the turnover cylinders 16 pull the supports 25, and the roller beds 26 on the left and right sides turn down; the motor I 2 drives the inner brush 24 and the large belt pulley 6 to rotate via the shaft II 11; meanwhile, the synchronous belt 7, the small belt pulleys 8 and the shafts 110 drive the gears I 19 to rotate; the gear rings 20 and the swivels 17 drive the outer brush 22 to rotate; the gear rings 20 are engaged with the gears II 21, so that the plurality of round brushes 23 also rotate; the cylinders II 41 drive the rotating inner brush 24, outer brush 22 and the plurality of round brushes 23 to rise via the guide posts I 4, and burrs on the back cavity can be removed when the brushes contact the back cavity of the wheel.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An online burr removing device for a wheel, comprising a frame, a motor I, a fixed plate I, four guide posts I, four guide sleeves I, a large belt pulley, a synchronous belt, small belt pulleys, a lower lifting plate, shafts I, a shaft II, bearing seats I, a transition sleeve, a bearing seat II, a fixed plate II, turnover cylinders, swivels, shafts III, gears I, gear rings, gears II, an outer brush, round brushes, an inner brush, supports, roller beds, end face blocks, corner cylinders, slide plates, guide rails, a fixed plate III, servo electric cylinders I, a shaft IV, a bearing seat III, an upper lifting plate, a motor II, four guide posts II, four guide sleeves II, two servo electric cylinders II, platforms and two cylinders II, characterized in that a brush moving system comprises: the four guide sleeves I and the two cylinders II are fixed on the fixed plate I, and the four guide posts I matched with the guide sleeves I are fixed below the lower lifting plate; output ends of the two cylinders II are articulated with a lower part of the lower lifting plate; the motor I is fixed below the lower lifting plate via a flange; the transition sleeve and the bearing seat II are fixed on the lower lifting plate, and the bearing seat II is arranged inside the transition sleeve; a plurality of bearing seats I are also fixed on the lower lifting plate and uniformly distributed outside the transition sleeve; the shaft II is installed inside the bearing seat II via a bearing; the large belt pulley is fixed below the shaft II; the shafts I are installed inside the bearing seats I via bearings; the gears I are installed above the shafts I, and the small belt pulleys are installed below the shafts I; the large belt pulley is connected with the small belt pulleys by the synchronous belt; the fixed plate II is fixed above the transition sleeve; an inner ring of each swivel is fixed above the fixed plate II, and an outer ring is fixed below one of the gear rings; the outer brush is installed above the gear rings; one of the gears I is engaged with an outer side of one of the gear rings; a plurality of shafts III are uniformly fixed above the fixed plate II; the gears II are installed on the shafts III via bearings; a plurality of round brushes are uniformly fixed above the gears II; the gears II are engaged with an inner side of the gear rings; the inner brush is fixed above the shaft II;

the device comprises a left online transfer unit and a right online transfer unit; each online transfer unit comprises: a cylinder body of a turnover cylinder is articulated to a side of the frame, and an output rod of each of the turnover cylinders is articulated with a lower part of each of the supports; a plurality of roller beds are installed above each of the supports; a left side of the left one of the supports is articulated with an upper part of one of the platforms; the device comprises three clamp units; each clamp unit comprises: one of the end face blocks and one of the corner cylinders are fixed below one of the slide plates; one of the slide plates is installed below the fixed plate III via one of the guide rails; the servo electric cylinders I is fixed on the fixed plate III, and an output end of the servo electric cylinders I is connected with one of the slide plates;

a lifting plate rotating part comprises: the four guide posts II are fixed on the upper lifting plate; the motor II is fixed in a middle of the upper lifting plate via a flange; the bearing seat III is fixed below the upper lifting plate; the shaft IV is installed inside the bearing seat III via a bearing; a lower part of the bearing seat III is connected with the fixed plate III, and an upper part of the bearing seat III is connected with an output end of the motor II; the four guide sleeves II matched with the guide posts II are fixed at a top of the frame; the two servo electric cylinders II are also fixed at a top of the frame, and output ends of the servo electric cylinders II are articulated with an upper part of the upper lifting plate;

in actual use, the two servo electric cylinders II adjust heights of the clamp units via the guide posts II according to a height of the wheel; the servo electric cylinders I adjust the positions of the clamp units via the guide rails according to the diameter of the wheel, the corner cylinders clamp the wheel, and the motor II drives the wheel to rotate via the shaft IV; the turnover cylinders pull the supports, and the roller beds on left and right sides turn down; the motor I drives the inner brush and the large belt pulley to rotate via the shaft II; meanwhile, the synchronous belt, the small belt pulleys and the shafts I drive the gears I to rotate; the gear rings and the swivels drive the outer brush to rotate; the gear rings are engaged with the gears II, so that the plurality of round brushes also rotate; the cylinders II drive the rotating inner brush, outer brush and the plurality of round brushes to rise via the guide posts I, and burrs on a back cavity can be removed when the plurality of round brushes contact the back cavity of the wheel.

* * * * *